US010811209B2

(12) United States Patent
Lim et al.

(10) Patent No.: US 10,811,209 B2
(45) Date of Patent: Oct. 20, 2020

(54) SWITCHING MECHANISM OF CIRCUIT BREAKER

(71) Applicant: LSIS CO., LTD., Anyang-si, Gyeonggi-do (KR)

(72) Inventors: Jeongjae Lim, Anyang-si (KR); Kihwan Oh, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 16/502,732

(22) Filed: Jul. 3, 2019

(65) Prior Publication Data

US 2020/0020499 A1 Jan. 16, 2020

(30) Foreign Application Priority Data

Jul. 10, 2018 (KR) ..... 10-2018-0080188

(51) Int. Cl.

| | |
|---|---|
| ***H01H 71/52*** | (2006.01) |
| ***H01H 71/02*** | (2006.01) |
| ***H01H 71/16*** | (2006.01) |
| ***H01H 89/04*** | (2006.01) |

(52) U.S. Cl.

CPC ..... *H01H 71/521* (2013.01); *H01H 71/0264* (2013.01); *H01H 71/16* (2013.01); *H01H 89/04* (2013.01)

(58) Field of Classification Search

CPC .. H01H 71/521; H01H 71/0264; H01H 71/16; H01H 89/04; H01H 71/526; H01H 71/52; H01H 71/50; H01H 73/50; H01H 71/525

USPC ..... 200/19.27

See application file for complete search history.

(56) References Cited

U.S. PATENT DOCUMENTS 4,090,158 A * 5/1978 Oeda ..... H01H 71/04 335/17
4,951,019 A * 8/1990 Gula ..... H01H 71/501 200/401
5,864,109 A * 1/1999 Ahn, II ..... H01H 33/666 218/120

FOREIGN PATENT DOCUMENTS

| | | | |
|---|---|---|---|
| JP | H02109231 | A | 4/1990 |
| JP | 2000164108 | A | 6/2000 |
| JP | 2002373564 | A | 12/2002 |
| JP | 2007265678 | A | 10/2007 |
| KR | 20040091401 | A | 10/2004 |
| KR | 101492222 | B1 | 2/2015 |

(Continued)

OTHER PUBLICATIONS

European Search Report for related European Application No. 19185078.3; action dated Nov. 29, 2019; (9 pages).

(Continued)

*Primary Examiner* — Edwin A. Leon
(74) *Attorney, Agent, or Firm* — K&L Gates LLP

(57) ABSTRACT

A switching mechanism of a circuit breaker includes a case, a handle rotatably coupled to a side plate fixed to the case, a U-pin coupled to a lower portion of the handle, a lever coupled to the U-pin, and a crossbar disposed in a mounting portion protruding from the case to be perpendicularly movable, the crossbar being moved by receiving contact pressure of the lever, wherein the lever is provided with a contact pressure portion formed in a curved surface on a lower surface thereof, to press the crossbar perpendicularly downward upon closing a circuit.

8 Claims, 10 Drawing Sheets

(56) References Cited

FOREIGN PATENT DOCUMENTS

KR 20160018005 A 2/2016

OTHER PUBLICATIONS

Japanese Office Action for related Japanese Application No. 2019-127523; action dated Sep. 4, 2020; (4 pages).

* cited by examiner

SWITCHING MECHANISM OF CIRCUIT BREAKER

CROSS-REFERENCE TO RELATED APPLICATION

Pursuant to 35 U.S.C. § 119(a), this application claims the benefit of an earlier filing date of and the right of priority to Korean Application No. 10-2018-0080188, filed on Jul. 10, 2018, the contents of which are incorporated by reference herein in its entirety.

BACKGROUND OF THE DISCLOSURE

1. Field of the Disclosure

The present disclosure relates to a circuit breaker, and more particularly, to a switching mechanism of a circuit breaker.

2. Description of the Related Art

Generally, a circuit breaker (simply, a breaker) is an electric device that is installed in a part of a transmission line, a transformer line, or an electric circuit to open and close a load or shut off the circuit when an accident such as short-circuit or the like occurs, so as to protect electric facilities and the load.

Among them, a small circuit breaker (small molded case circuit breaker) is installed in a small distribution board that constructs a low voltage circuit (15 to 30 A) of AC 110/220V and is used for overcurrent protection and short-circuit protection. The small circuit breaker is used as a switch which is disposed in a distribution board in a house, a market, an office, a department store, and the like, to conveniently open and close a plurality of loads at one place. The small breaker is also used for switching on and off machine tools, factory facilities, and the like.

The small circuit breaker, similar to typical circuit breakers used in industrial fields, includes a contact portion having a fixed contact and a movable contact, a switching mechanism to switch on and off the contact portion, a detection mechanism to detect an abnormal current, a trip portion to protect lines and a load by opening the switching mechanism upon an occurrence of an abnormal current such as overcurrent or short-circuit current, and an arc-extinguishing portion to extinguish and cool arc generated while breaking a circuit.

FIG. 1 illustrates a small circuit breaker according to the related art. A top cover is shown as removed. FIG. 1 illustrates a case 1 for maintaining insulation from outside and fixing and supporting each component, a terminal portion 2 connected to a power source or a load, a switching mechanism having a handle 3, a contact portion having a fixed contactor 4 and a movable contactor 5, a trip portion having a bimetal 14 and a trip bar 11, and the like.

FIGS. 2 and 3 illustrate a switching mechanism of a small circuit breaker according to the related art. FIG. 2 illustrates an open state and FIG. 3 illustrates a current-flowing state.

The switching mechanism includes a handle 3 rotatably coupled to an upper portion of a side plate 6, a trip bar 11 rotatably coupled to one side of the side plate 6, a trip bar pin 12 serving as a shaft of the trip bar 11, a trip bar spring 13 providing a restoring force to the trip bar 11, a U-pin 7 coupled to a lower portion of the handle 3 to operate a lever 8, a lever 8 connected to the U-pin 7 to operate a crossbar 9 during movement and having one end restricted by the trip bar 11.

Hereinafter, a closing operation in the related art small circuit breaker will be described.

When the user applies a force F1 to the handle 3 in a counterclockwise direction, the handle 3 rotates centering on a rotary shaft 10. The U-pin 7 coupled to the lower portion of the handle 3 is moved by receiving the force of the handle 3. At this time, since a portion of the U-pin 7 which is coupled to the handle 3 is located at a lower left side of the rotary shaft 10, the U-pin 7 receives a force F2 applied to a lower right side of the rotary shaft 10. Accordingly, an upper end portion of the U-pin 7 is moved to the lower right side, and a lower end portion of the U-pin 7 is moved downward along a groove formed in the side plate 6.

On the other hand, since the U-pin 7 is coupled to a center portion of the lever 8, the lever 8 is also moved downward as the U-pin 7 is moved downward. Since the lever 8 is in contact with the crossbar 9, the lever 8 is moved together with the crossbar 9. The movable contactor 3 is pushed downward by the crossbar 9 to be brought into contact with the fixed contactor 3, so that currents can flow (i.e., a circuit can be in a current-flowing state), as illustrated in FIG. 3.

Here, the crossbar 9 is disposed on the left side of the center of the lever 8 (the coupled portion between the lever and the U-pin). Therefore, a force F3 applied by the lever 8 to the crossbar 9 proceeds to the lower left side. On the other hand, the crossbar 9 is installed in an operation groove 1*b*, which is perpendicularly formed in a mounting portion 1*a* protruding from the case 1, and movable up and down in the operation groove 1*b* (see FIG. 4). Due to this structure, the crossbar 9 is moved perpendicularly downward and the force F3 applied by the lever 8 to the crossbar 9 proceeds to the lower left side. As a result, the crossbar 9 is twisted at its upper and lower end portions without smoothly moving up and down within the operation groove 1*b*, thereby causing friction with the operation groove 1*b*. In other words, a loss of current interruption performance is caused.

SUMMARY OF THE INVENTION

The present disclosure has been invented to solve those problems and other drawbacks, and one aspect of the present disclosure is to provide a switching mechanism of a circuit breaker, capable of maximizing current interruption performance by reducing friction between a crossbar and a mounting portion of a case.

To achieve the aspect and other advantages according to one embodiment of the present disclosure, there is provided a switching mechanism of a circuit breaker, the switching mechanism including a case, a handle rotatably coupled to a side plate fixed to the case, a U-pin coupled to a lower portion of the handle, a lever coupled to the U-pin, and a crossbar disposed in a mounting portion protruding from the case to be perpendicularly movable, the crossbar being moved by receiving contact pressure of the lever, wherein the lever is provided with a contact pressure portion formed in a curved surface on a lower surface thereof, to press the crossbar perpendicularly downward upon breaking a circuit.

Here, the mounting portion may be provided with a cutout portion formed in a shape of a linear groove so that the crossbar is movable up and down therein.

The crossbar may be provided with a head portion protruding from an upper surface thereof to come in contact with the lever.

The head portion may have an inner edge formed as a curved surface.

The contact pressure portion may include a first curved portion having a radius of curvature increasing from a peak down to inclined surfaces.

The first curved portion may be provided with an inflection portion having an inflection point on a part of each inclined surface.

The contact pressure portion may be further provided with a second curved portion formed at a predetermined distance from the first curved portion.

The second curved portion may have a lower height than the first curved portion.

In a switching mechanism of a circuit breaker according to one embodiment of the present disclosure, a crossbar receives a force, which is applied perpendicularly downward by a contact pressure portion of a lever during a closing operation, thereby performing perpendicular downward motion.

The perpendicular downward motion is achieved by a first curved portion formed on a contact pressure portion of a lever. In addition, such perpendicular downward motion is assisted by a plate or a second curved portion of the lever.

BRIEF DESCRIPTION OF THE DRAWINGS

FIG. 2 shows an open state, and FIG. 3 shows a current-flowing state.

FIG. 9 shows an open state, and FIG. 10 shows a current-flowing state.

DETAILED DESCRIPTION OF THE DISCLOSURE

Hereinafter, preferred embodiments of the present invention will be described with reference to the accompanying drawings, so that a person skilled in the art can easily carry out the invention. It should be understood that the technical idea and scope of the present invention are not limited to those preferred embodiments.

Hereinafter, a switching mechanism of a circuit breaker in accordance with each embodiment of the present disclosure will be described in detail with reference to the accompanying drawings.

Figure 1:
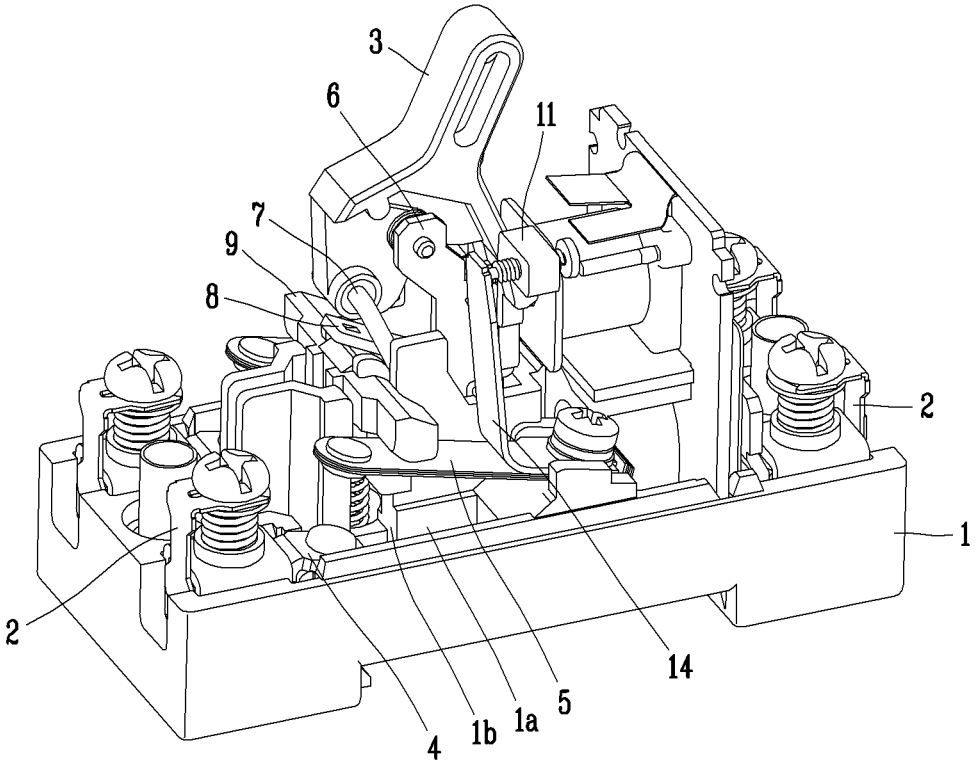
FIG. 1 PRIOR ART
FIG. 1 is an inner perspective view of a circuit breaker according to the related art.
Figure 2:
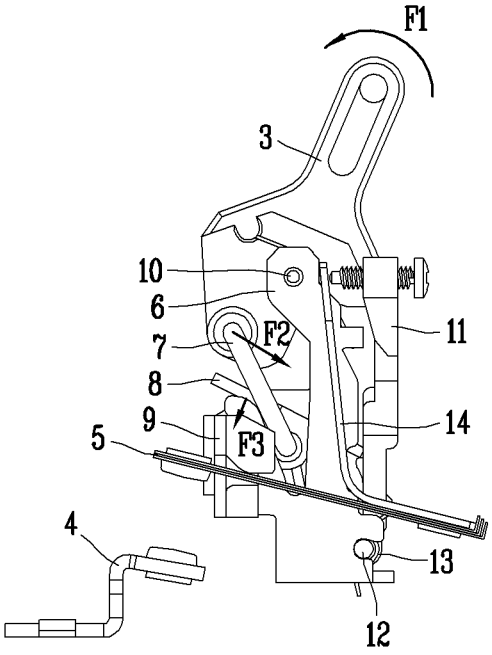
FIG. 2 PRIOR ART
FIGS. 2 and 3 are operation views of a switching mechanism in FIG. 1.
Figure 3:
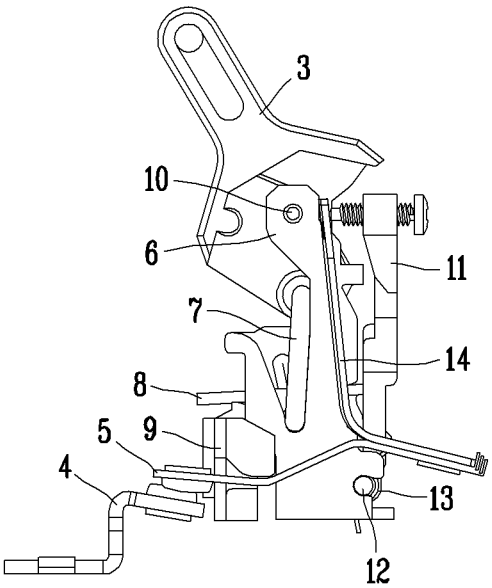
FIG. 3 PRIOR ART
Figure 4:
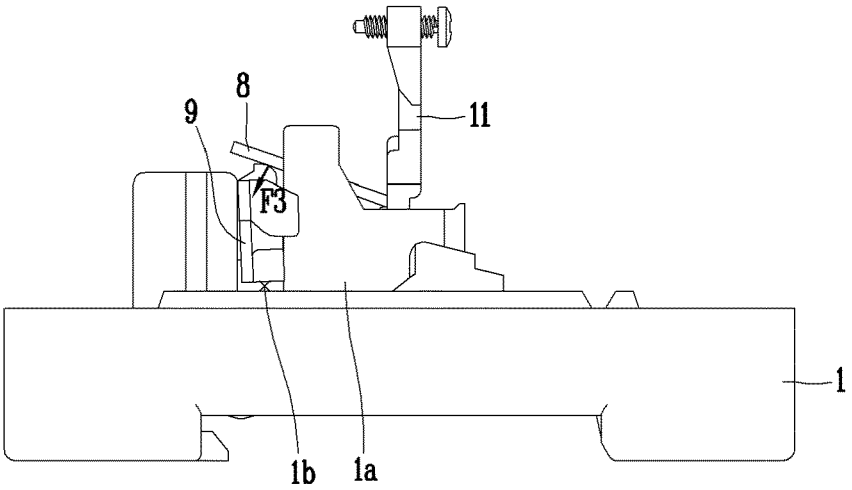
FIG. 4 PRIOR ART
FIG. 4 is a front view illustrating an operating state of a crossbar in FIG. 1.
Figure 5:
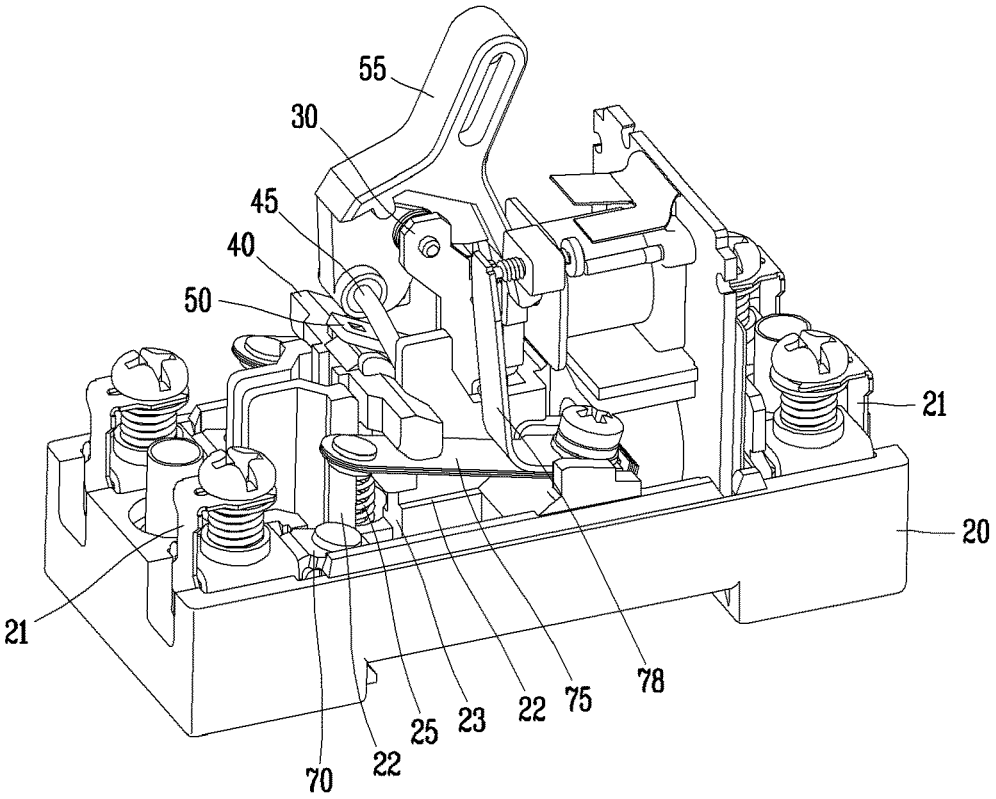
FIG. 5 is an inner perspective view of a circuit breaker in accordance with one embodiment of the present disclosure.
Figure 6:
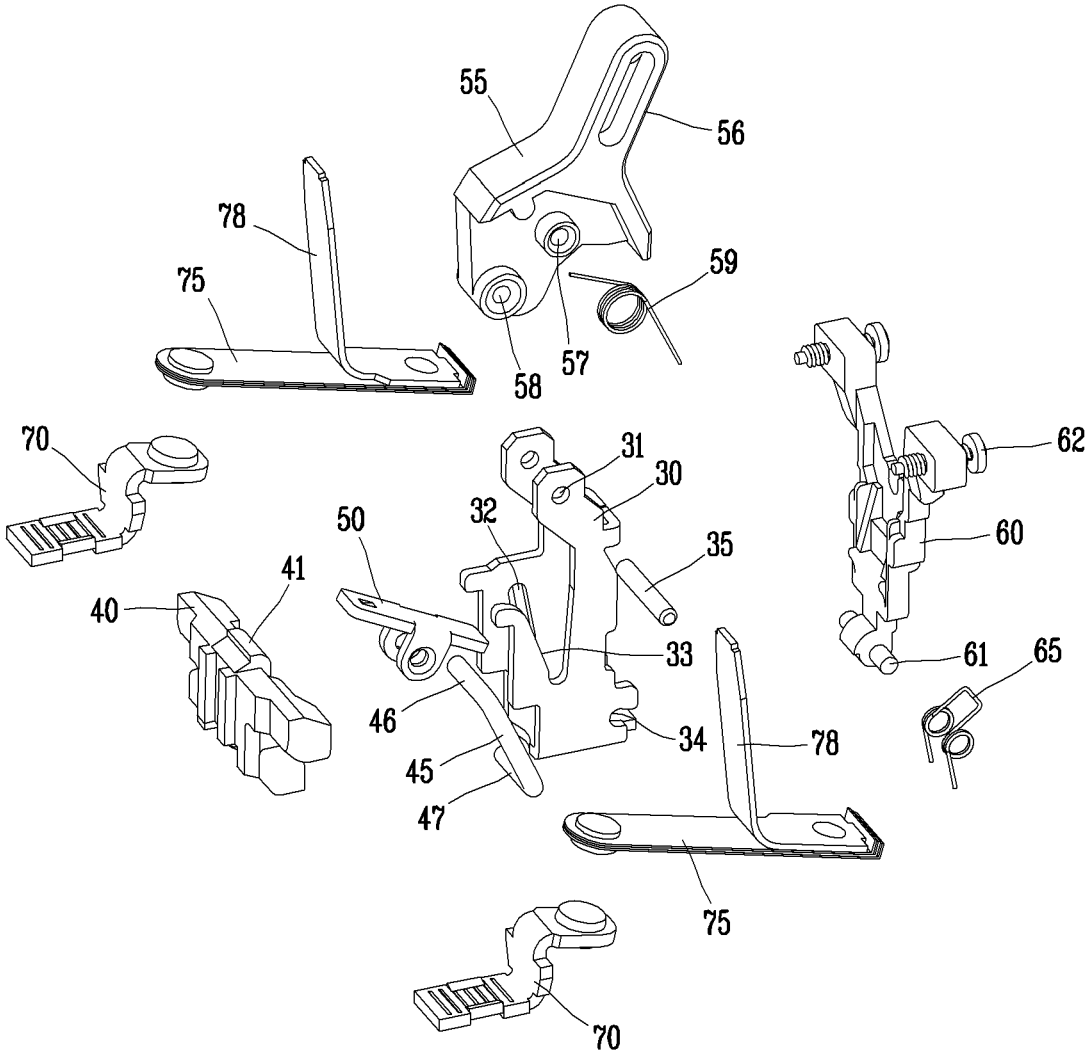
FIG. 6 is an exploded perspective view of a switching mechanism in FIG. 5.

FIG. 5 is an inner perspective view of a circuit breaker according in accordance with one embodiment of the present disclosure, and FIG. 6 is an exploded perspective view of a switching mechanism in FIG. 4.

A switching mechanism of a circuit breaker according to one embodiment of the present disclosure includes a case 20, a handle 55 rotatably coupled to a side plate 30 provided on the case 20, a U-pin coupled to a lower portion of the handle 55, a lever 50 movably coupled to the U-pin 45, and a crossbar 40 installed at a mounting portion 22 of the case 20 to be perpendicularly movable by receiving a force from the lever 50. A contact pressure portion 54 in a curved shape is disposed on a lower surface of the lever 50 so as to press the crossbar 40 perpendicularly downward.

An enclosure forming appearance of the circuit breaker according to one embodiment of the present disclosure may be formed in a box shape and include a case 20 having an opened upper surface, and a cover (not shown) having an opened lower surface to be coupled to an upper portion of the case 20.

The case 20 is provided therein with components, such as a contact portion including a fixed contactor 70 and a movable contactor 75, a switching mechanism including the handle 55, a trip portion including a bimetal 78, a terminal portion 21 connected to a load or power source, and the like.

The case 20 includes terminal portions 21 provided on both sides thereof and connectable with a power source and a load. Typically, in the circuit breaker illustrated in FIG. 5, the left terminal portion is connected to the power source and the right terminal portion is connected to the load.

The fixed contactor 70 is provided on one terminal portion 21. That is, the fixed contactor 70 is provided on the power source side.

The movable contactor 75 is provided at a middle portion of the case 20. The movable contactor 75 is brought into contact with or separated from the fixed contactor 70. The movable contactor 75 is connected to the other terminal portion 21, that is, the load side. The movable contactor 75 may be coupled with the bimetal 78.

A mounting portion 22 on which a side plate 30 and the crossbar 409 can be mounted is provided on a center portion of the case 20. The mounting portion 22 may have an accommodation space therein. A cutout portion 23 is formed in a shape of a groove on one side of the mounting portion 22 so that the crossbar 40 moves up and down therein. The cutout portion 23 is formed linearly in a perpendicular direction when viewed from a side (see FIG. 11).

The crossbar 40 is disposed in the cutout portion 23 of the mounting portion 22 to be movable up and down. A return spring 25 is provided below the crossbar 40 to move the crossbar 40 upward if there is no force applied to the crossbar 40.

A head portion 41 protrudes from a top of the crossbar 40. The head portion 41 is a portion which receives a force by being brought into contact with the contact pressure portion 54 of the lever 50. An upper surface of the head portion 41 is formed to be horizontally flat. An edge of an inner surface (power source side surface) of the head portion 41 is smoothly formed into a curved surface.

The side plate 30 is fixedly installed inside the mounting portion 22. The side plate 30 includes a pair of side surfaces disposed side by side. Shaft holes 31 through which a rotary shaft 35 can be inserted are formed through upper portions of the side surfaces of the side plate 30. A guide hole 32 or a guide groove 33 for guiding movement of the U-pin 45 is formed at a middle portion of the side plate 30. The guide hole 32 or the guide groove 33 is formed to have a predetermined inclination angle with respect to a perpendicular direction. Shaft grooves 34 in which a shaft 61 of a trip bar 60 is inserted are formed in lower portions of the side surfaces of the side plate 30.

The handle 55 is rotatably mounted on an upper portion of the side plate 30. The handle 55 is provided with a pressing portion 56 protruding upward so that a user can hold it and apply a force. The handle 55 is provided with a first hole 57 through which the rotary shaft 35 is inserted and a second hole 58 through which an upper end portion of the U-pin 45 is inserted. In an open state, the second hole 58 is located at the lower left side of the first hole 57. A handle spring 59 is provided to return the handle 55.

The U-pin 45 is provided. The U-pin 45 is formed in a shape like an alphabet 'U' (similar to '⊏'), so that its upper end portion 46 is coupled to the second hole 58 of the handle 55 and its lower end portion 47 is coupled to the lever 50. The U-pin 45 transfers an operation force of the handle 55 to the lever 50.

The lever 50 is moved downward by the force from the U-pin 45 and presses the crossbar 40 so that the crossbar 40 is moved downward.

Figure 7:
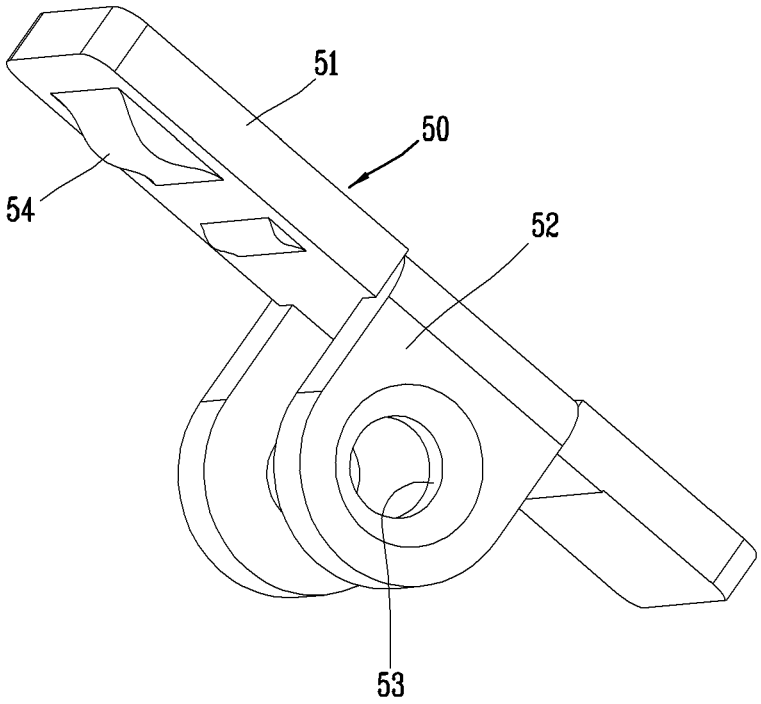
FIGS. 7 and 8 are a detailed perspective view and a partial front view, respectively, of a lever in FIG. 6.
Figure 8:
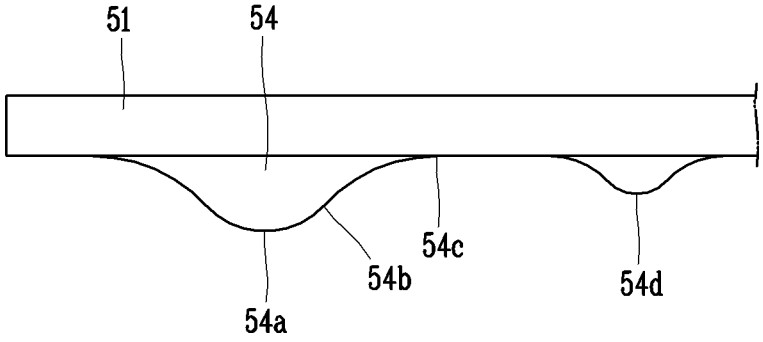

FIGS. 7 and 8 are a detailed perspective view and a partial front view of the lever.

The lever 50 includes a plate 51 and a wing portion 52 bent perpendicularly from the middle portion of the plate 51. The wing portion 52 may be configured as a pair on both side surfaces of the plate 51, respectively. Each of the pair of wing portions 52 is provided with a coupling hole 53 through which the lower end portion 47 of the U-pin 45 is inserted. The lever 50 is moved downward by an operation force of the U-pin 45 coupled to the coupling hole 53.

The contact pressure portion 54 is provided on a lower surface of the lever 50 at a front end portion of the lever 50. The contact pressure portion 54 is a portion which is brought into contact with the head portion 41 of the crossbar 40 and applies a force to the head portion 41. The crossbar 40 is moved downward as the contact pressure portion 54 presses the head portion 41 of the crossbar 40.

The surface of the contact pressure portion 54 which is brought into contact with the head portion 41 of the crossbar 40 is a curved surface. The contact pressure portion 54 includes a first curved portion 54*a*. The first curved portion 54*a* is formed like a gentle hill. At this time, the first curved portion 54*a* becomes gentle from its peak down to inclined surfaces. That is, the radius of curvature of the first curved portion 54*a* is increased.

An inflection portion 54*b* which corresponds to an inflection point is formed on a portion of each inclined surface of the first curved portion 54*a*. Therefore, a border portion 54*c* which is a portion where the first curved portion 54*a* extends from the inflection portion 54*b* to come in contact with the plate 51 forms a smooth inclined surface.

In addition, a second curved portion 54*d* may be provided at a predetermined distance from the first curved portion 54*a*. At this time, the second curved portion 54*d* may be formed at a lower height than the first curved portion 54*a*. The second curved portion 54*d* is formed in a shape similar to the first curved portion 54*a*.

The trip bar 60 is provided to lock the lever 50 in a normal state and to release the lever 50 to cause a trip operation upon an occurrence of a fault current. The trip bar 60 is rotated as the bimetal 78 is bent, thereby unlocking the locked lever 50. The trip bar 60 is subjected to a force proceeding forward by the force of the return spring 65 in the normal state. When the bimetal 78 is bent due to an occurrence of a fault current, the trip bar 60 is pushed backward, so that the trip bar 60 releases the locked lever 50. Accordingly, the trip operation is executed and the circuit is shut down.

The trip bar 60 is formed roughly in a 'Y' shape. Adjustment members 62 for adjusting an interval from the bimetal 78 are coupled to an upper end of the trip bar 60. The bimetal 78 presses the adjustment members 62 so that the trip bar 60 is rotated.

When an overcurrent or a fault current flows in the circuit, more currents also flow on the bimetal 78 coupled to the movable contactor of the contact portion and thus heat is generated in the bimetal 78. As a result, the bimetal 78, which is made of a thermally-deformable material, is bent (or curved). The bimetal 78 pushes the trip bar 60 while being bent, so that the lever 50 locked in the trip bar 60 is unlocked. Accordingly, the crossbar 40 is returned and the movable contactor 75 is separated from the fixed contactor 70, thereby breaking the circuit.

Hereinafter, a closing operation of a switching mechanism of a circuit breaker in accordance with one embodiment of the present disclosure will be described, with reference to FIGS. 9 and 10.

Figure 9:
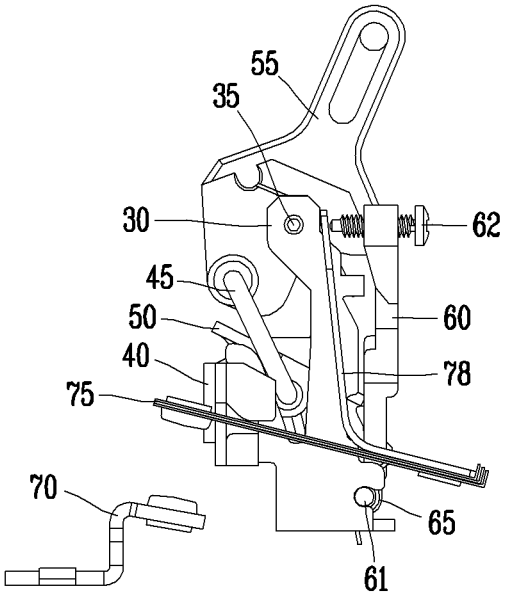
FIGS. 9 and 10 are operation views of a switching mechanism of a circuit breaker in accordance with one embodiment of the present disclosure.

First, in an open state as illustrated in FIG. 9, when the user turns the handle 55 in a counterclockwise direction, the handle 55 is rotated in the counterclockwise direction centering on the rotary shaft 35. The U-pin 45 coupled to the lower portion of the handle 55 is moved together with the handle 55. At this time, since the portion of the U-pin 45 which is coupled to the handle 55 is located at the lower left side of the rotary shaft 35, the U-pin 45 receives a force applied to the lower right side when the handle 55 is rotated in the counterclockwise direction. Accordingly, the upper end portion 46 of the U-pin 45 is moved to the lower right side, and the lower end portion 47 of the U-pin 45 is moved downward along the guide hole 32 or the guide groove 33 of the side plate 30.

On the other hand, since the lower end portion 47 of the U-pin 45 is coupled to the coupling hole 53 of the wing portion 52 of the lever 50, the U-pin 45 is moved downward together with the lever 50. At this time, since the lever 50 is in contact with the crossbar 40, the lever 50 is moved downward together with the crossbar 40. The movable contactor 75 is pushed downward by the crossbar 40 to be brought into contact with the fixed contactor 70, so that the circuit is in a current-flowing state as illustrated in FIG. 10.

Hereinafter, an opening operation will be described.

Figure 10:
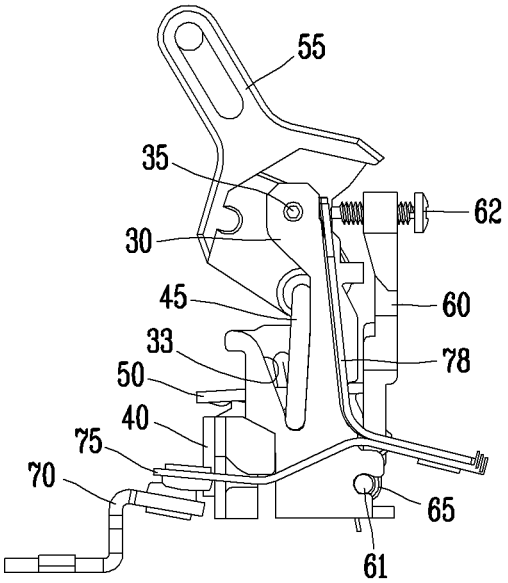

When the user turns the handle 55 in a clockwise direction in the current-flowing state illustrated in FIG. 10, the U-pin 45 coupled to the handle 55 is pulled to the upper left side. The lever 50 coupled to the U-pin 45 is also pulled upward and accordingly a pressing force applied to the crossbar 40 is removed. The crossbar 40 is returned upward by the restoring force of the return spring 25. Accordingly, the movable contactor 75 is separated from the fixed contactor 70 and the circuit is opened accordingly.

Figure 12:
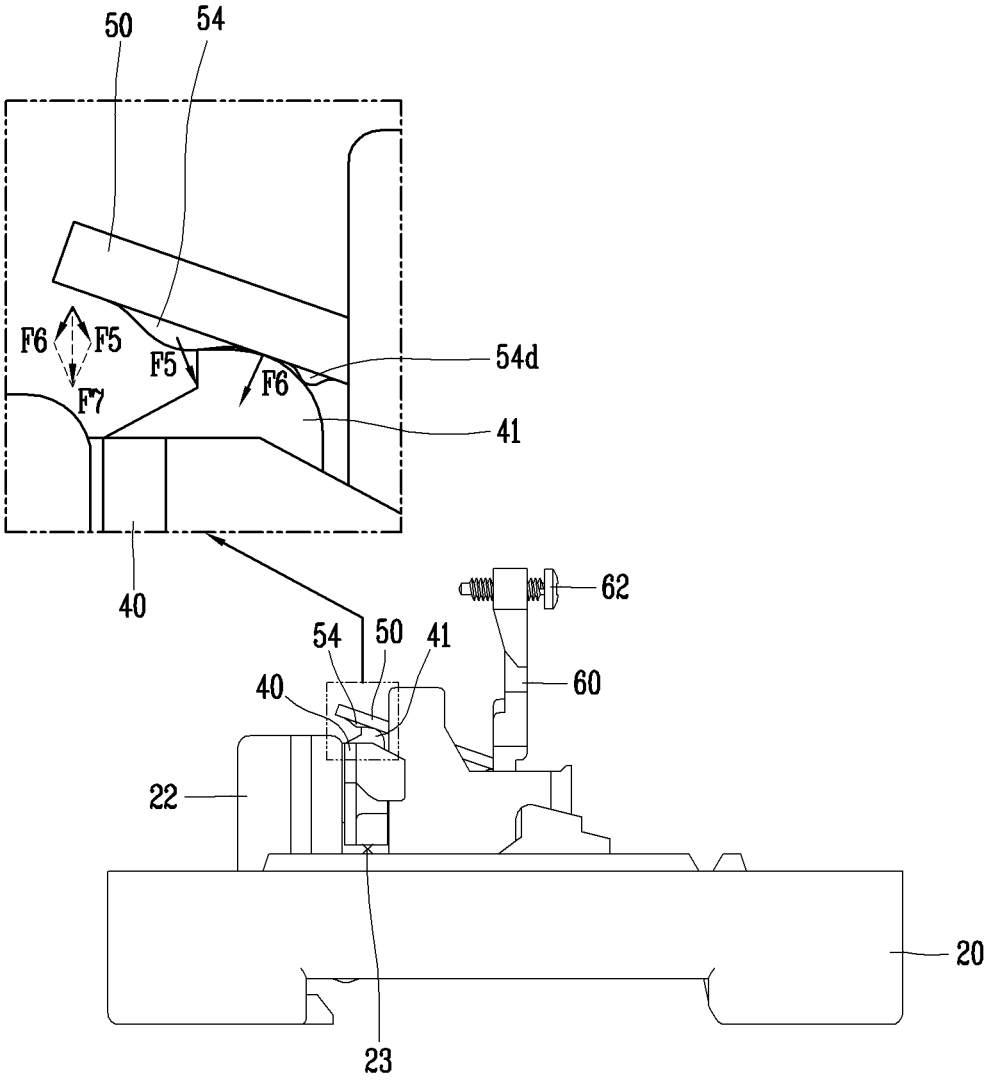
Figure 13:
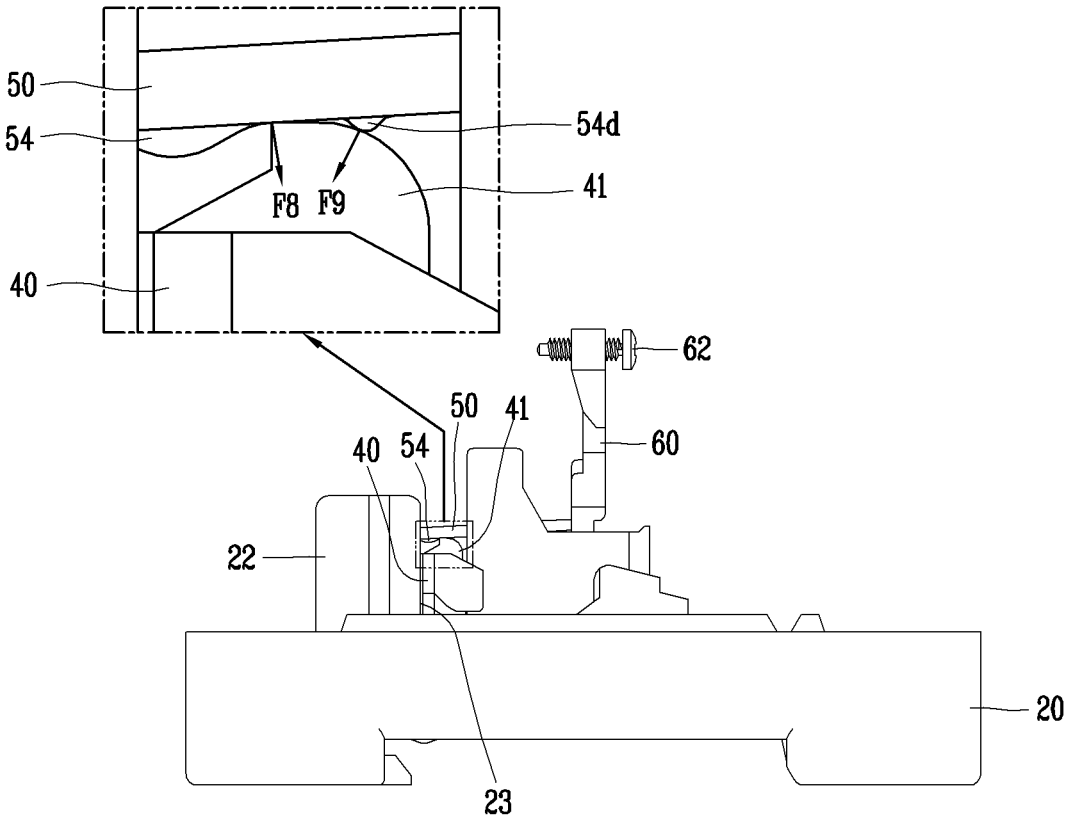

Hereinafter, the operations of the lever 50 and the crossbar 40 in the closing operation will be described in more detail with reference to FIGS. 11 to 13.

Figure 11:
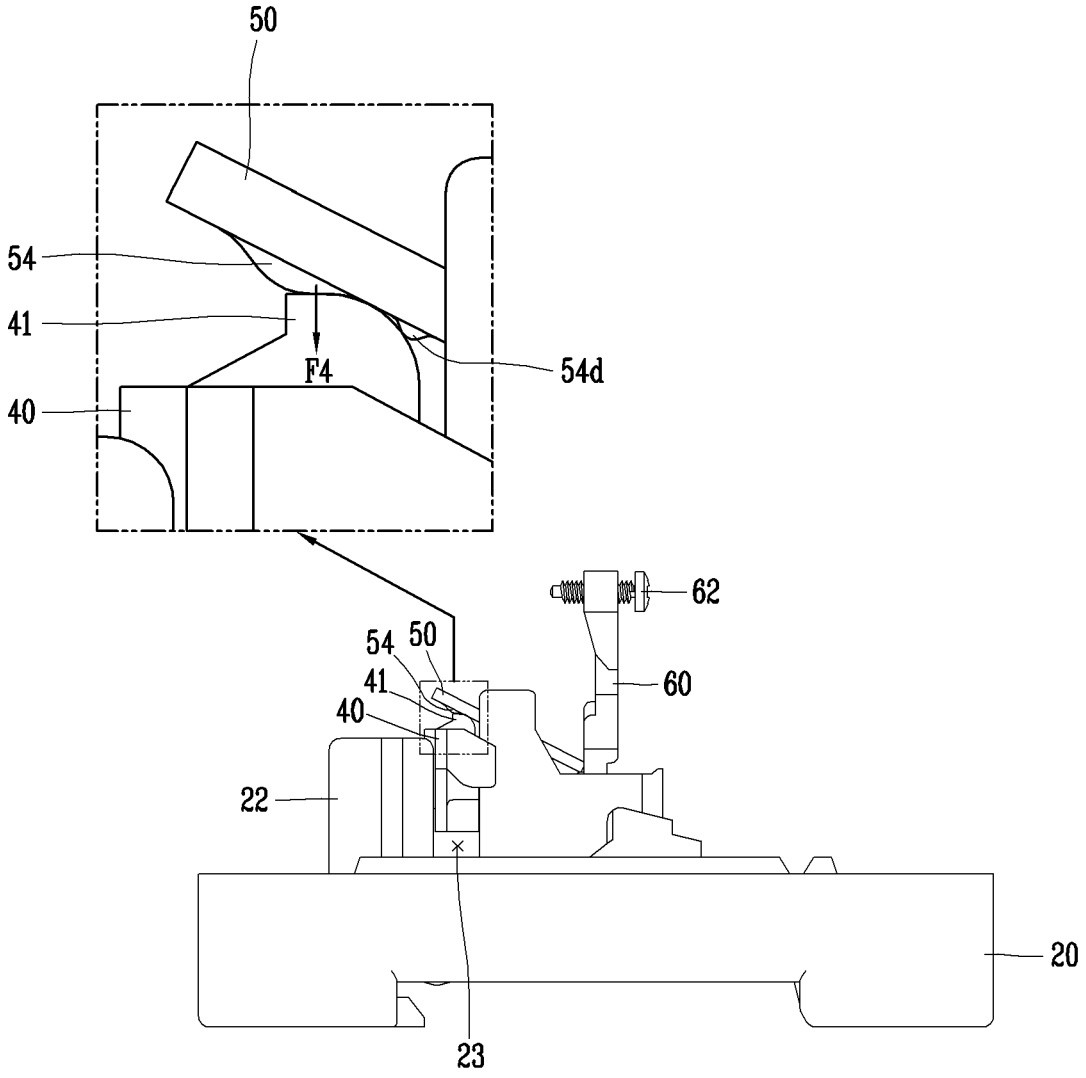
FIGS. 11 to 13 are views illustrating operating states of a lever and a crossbar during an operation between FIGS. 9 and 10.

First, in an open state as illustrated in FIG. 11, the lever 50 is erected by a predetermined angle toward the upper left side. The inflection portion 54*b* of the contact pressure portion 54 is in contact with the head portion 41 of the crossbar 40. At this time, when the closing operation is executed as the user turns the handle, the lever 50 is rotated centering on the coupling hole 53 so as to press the crossbar 40. Here, since the inflection portion 54*b* of the contact pressure portion 54 applies a force in a state of being substantially horizontal to the crossbar 40, the crossbar 40 receives a force F4 applied downward.

When the lever 50 is rotated, a portion of the head portion 41 brought into contact with the lever 50 is moved to an outer side of the head portion 41 from the upper surface of the head portion 41, and a portion of the crossbar 40 which is in contact with the first curved portion 54*a* is moved from the inflection portion 54*b* toward the border portion 54*c*. Therefore, the crossbar 40 is subjected to a force applied in an inclined direction, for example, a force F5 illustrated in FIG. 12. On the other hand, an inner side of the head portion 41 is subjected to a force F6 applied in an opposite direction to the inclined direction of the force F5, by the inclined surface between the first curved portion 54*a* and the second curved portion 54*d* or by the second curved surface portion 54*d*. Accordingly, the crossbar 40 receives a force F7, which is the sum of the force F5 applied between the first curved portion 54*a* and the head portion 41 and the force F6 applied between the plate 51 or the second curved portion 54*a* and the head portion 41. As a result, the crossbar 40 is moved downward smoothly by the downwardly-applied force.

When the lever 50 is further rotated, the first curved portion 54*a* is separated from the head portion 41 and the plate 51 and the second curved portion 54*d* are brought into contact with the head portion 41. At this time, the crossbar 40 is subjected to a downwardly-applied force by the sum of a force F8 applied between the plate 51 and the head portion 41 and a force F9 applied between the second curved portion 54*d* and the head portion 41 (See FIG. 13).

Figure 14:
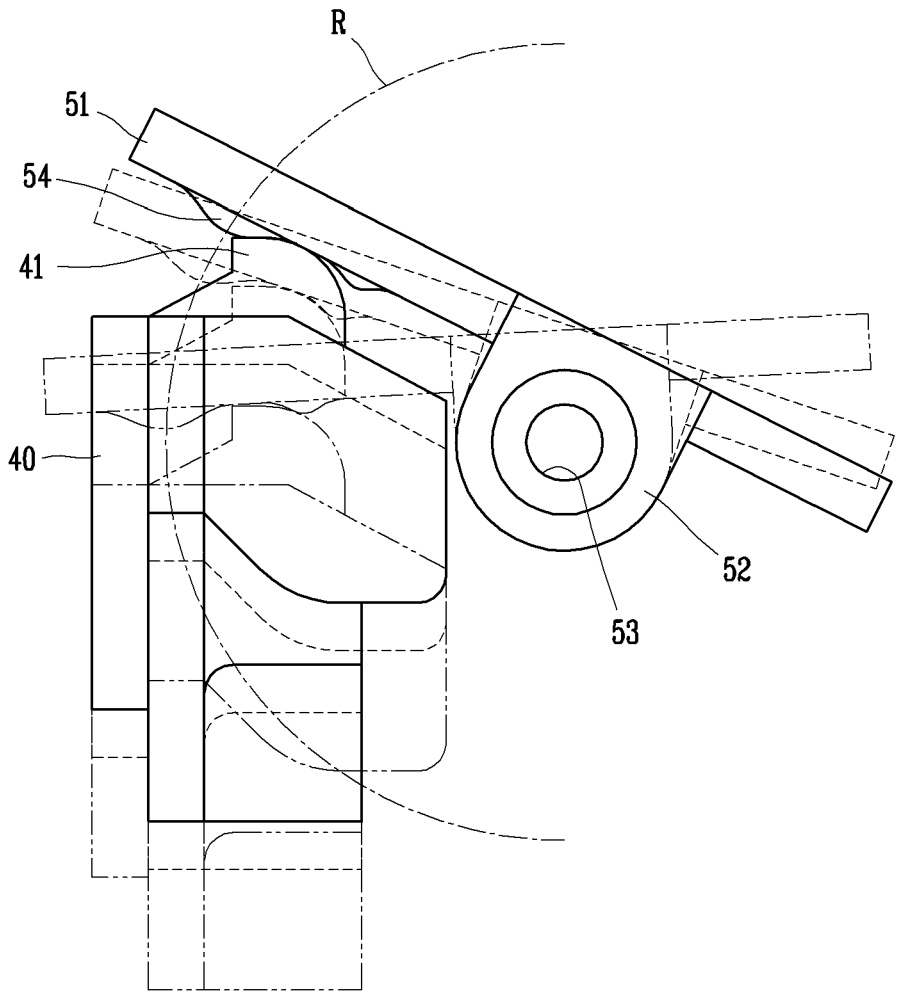
FIG. 14 is a view dynamically showing an operating state between the lever and the crossbar in FIG. 13.

Such operations between the lever 50 and the crossbar 40 are shown collectively in FIG. 14 so as to be more intuitively understood. When the lever 50 presses the crossbar 40 while rotating centering on the coupling hole 53, the lever 50 applies a force perpendicularly downward to the crossbar 40 and accordingly the crossbar 40 performs a perpendicular linear motion.

Therefore, the crossbar 40 is stably moved perpendicularly by receiving the force which is applied perpendicularly downward while the closing operation is executed, and does not cause friction within the cutout portion 23.

In the small circuit breaker according to one embodiment of the present disclosure, the crossbar receives the force, which is applied perpendicularly downward by the contact pressure portion of the lever during the closing operation, thereby being moved downward perpendicularly.

The perpendicular downward motion is achieved by the first curved portion formed on the contact pressure portion of the lever. In addition, such perpendicular downward motion is assisted by the plate or the second curved portion of the lever.

While the invention has been shown and described with reference to the foregoing preferred embodiments thereof, it will be understood by those skilled in the art that various changes and modifications may be made without departing from the spirit and scope of the invention as defined by the appended claims. Therefore, the embodiments disclosed in the present disclosure are not intended to limit the scope of the present disclosure but are merely illustrative, and it should be understood that the scope of the technical idea of the present disclosure is not limited by those embodiments. That is, the scope of protection of the present invention should be construed according to the appended claims, and all technical ideas within the scope of equivalents thereof should be construed as being included in the scope of the present invention.

What is claimed is:

1. A switching mechanism of a circuit breaker, the switching mechanism comprising:

a case;

a handle rotatably coupled to a side plate fixed to the case;

a U-pin coupled to a lower portion of the handle;

a lever coupled to the U-pin; and a crossbar disposed in a mounting portion protruding from the case to be perpendicularly movable, the crossbar being moved by receiving contact pressure of the lever, wherein the lever is provided with a contact pressure portion protruding from the lever and formed in a curved surface on a lower surface thereof, to press the crossbar perpendicularly downward upon closing a circuit, and wherein a surface of the contact pressure portion which is brought into contact with the crossbar is curved.

2. The switching mechanism of claim 1, wherein the mounting portion is provided with a cutout portion formed in a shape of a linear groove so that the crossbar is movable up and down therein.

3. The switching mechanism of claim 1, wherein the crossbar is provided with a head portion protruding from an upper surface thereof to come in contact with the lever.

4. The switching mechanism of claim 3, wherein the head portion has an inner edge formed as a curved surface.

5. The switching mechanism of claim 1, wherein the contact pressure portion comprises a first curved portion having a radius of curvature increasing from a peak down to inclined surfaces.

6. The switching mechanism of claim 5, wherein the first curved portion is provided with an inflection portion having an inflection point on a part of each inclined surface.

7. The switching mechanism of claim 5, wherein the contact pressure portion is further provided with a second curved portion formed at a predetermined distance from the first curved portion.

8. The switching mechanism of claim 7, wherein the second curved portion has a lower height than the first curved portion.

* * * * *